United States Patent [19]

Lubke

[11] Patent Number: 4,522,560

[45] Date of Patent: Jun. 11, 1985

[54] LIQUID-RING COMPRESSOR FOR GASES

[75] Inventor: Wilfried Lubke, Ammerndorf, Fed. Rep. of Germany

[73] Assignee: Siemens Aktiengesellschaft, Munich, Fed. Rep. of Germany

[21] Appl. No.: 466,008

[22] Filed: Feb. 14, 1983

[30] Foreign Application Priority Data

Mar. 19, 1982 [DE] Fed. Rep. of Germany ..... 3210161

[51] Int. Cl.[3] ..... F04C 19/00

[52] U.S. Cl. ..... 415/210; 417/68

[58] Field of Search ..... 415/210, 216, 217, 119; 417/68

[56] References Cited

U.S. PATENT DOCUMENTS 1,180,613 4/1916 Siemen ..... 417/68
3,108,738 10/1963 Luhmann ..... 417/68
3,884,596 5/1975 Hoffmeister ..... 417/68
4,074,954 2/1978 Roberts ..... 417/68
4,392,783 7/1983 Jozepaitis ..... 417/68

FOREIGN PATENT DOCUMENTS 15231 of 1915 United Kingdom ..... 417/68

*Primary Examiner*—Henry C. Yuen
*Assistant Examiner*—John Kwon
*Attorney, Agent, or Firm*—Kenyon & Kenyon

[57] ABSTRACT

In a liquid-ring rotary compressor, a control disc has, ahead of a sickle-shaped pressure or outlet slot, a multiplicity of spaced radial slots with width and shape conforming to the width and profile of the impeller blades. One such disc is usable for different pressure ratios without requiring a change in the relative position of the compressor housing.

11 Claims, 7 Drawing Figures

LIQUID-RING COMPRESSOR FOR GASES

BACKGROUND OF THE INVENTION

This invention relates in general to a liquid-ring rotary compressor and more particularly to a control disc in such a compressor for at least partially determining the output pressure thereof.

A liquid-ring rotary compressor comprises a machine housing generally with a substantially cylindrical compression chamber, a pair of bell-shaped support plates at opposite ends of the housing and an impeller located in the compression chamber. The impeller has a shaft journaled at opposite ends in the support plates or end bells and a multiplicity of substantially radial blades defining a multiplicity of blade chambers rotable within the housing. A control disc disposed between one of the bell-shaped support members and the housing is provided with a sickle-shaped suction slot and a sickle-shaped pressure slot, the pressure slot having a substantially radial leading edge. The support member juxtaposed to the control disc has a gas intake and a gas outlet communicating with the blade chambers via the suction slot and the pressure slot, respectively. The control disc is further provided with channels or ducts for enabling the passage of liquid (e.g. water) into and out of the compression chamber and with a multiplicity of ancillary pressure openings distributed in an arc-shaped region located circumferentially in front of the pressure slot, as determined by the direction of rotation of the impeller. The arc-shaped region extends in a radial direction beyond the outer end of the leading edge of the pressure slot, while the pressure openings have, in the circumferential direction, dimensions matched to the thickness of the impeller blades.

Liquid-ring rotary compressors described in Siemens price list P 20, Part I., July 1964, pages 4 and 5, and Siemens publication E725/1013, "Vacuum Pumps and Compressors, Siemens System ELMO-F" ("Vakuumpumpen und Verdichter, Siemens System ELMO-F"), have a circulating water feed or pressurized liquid passage behind the suction slot, relative to the direction of impeller rotation, for admitting the gap-sealing liquid (e.g. water) to the compression chamber. The pressure outlet in the control disc is constituted by the sickle-shaped pressure slot together with holes in the arc-shaped region preceding the pressure slot. The size of the pressure outlet, and in particular of the pressure slot, determines the ratio of the final or outlet pressure to the suction or inlet pressure. Thus the beginning of the pressure outlet, relative to the direction of rotation of the impeller, must be adapted to the desired pressure ratio. To this end the position of the inner contour of the housing relative to the pressure outlet must be adjusted. The hole of the arc-shaped area which are situated in the output pressure region allow the compressed gas to penetrate from the front side of the control disc, i.e. the side facing the impeller, to the back side of the control disc more easily than the holes farther removed from the output pressure region, since the liquid located on the back side of the control disc closes off the holes on which less pressure acts on the front side, so that in practice a sort of liquid valve action occurs.

For larger pressure ratios a plate valve is frequently provided on the back side for aiding the action of the liquid valve.

Because the diameter of the holes must be adapted to the thickness of the blades and a ratio of a hole diameter to blade thickness of 1.2:1 should not be exceeded, the flow velocity must not fall below a limit and corresponding flow losses must be tolerated. The ratio of hole diameter to blade thickness is chosen in view of detrimental back flow via hole to hole from one blade chamber to another, since excessive back flow cancels possible efficiency improvement by a decrease of the flow losses due to smaller flow resistances. Increasing the number of holes for the purpose of reducing the flow velocity is possible neither in the radial direction nor in the circumferential direction, since in the former case the rotating liquid ring is adversely affected and in the latter case the pressure ratio would be reduced.

An object of this inventon is to achieve in a liquid-ring compressor a reduction of the required power consumption and an improvement in efficiency for pressure ratios varying over a wide range, while eliminating the need for a housing adjustment.

SUMMARY OF THE INVENTION

In a liquid-ring compressor a control disc according to the present invention has, in the arc-shaped area ahead of the pressure slot, a multiplicity of pressure openings in the form of radially extending slots spaced from each other in the circumferential direction. The radial slots have widths matched to the thickness of the blades of the impeller. Preferably, the length of the radial slots is greater than twice the slot width, while the arc-shaped area has a uniform radial breadth.

Providing radial slots with a slot width adapted to the thickness of the impeller blades increases exit cross sections, while the passage area remains the same, and the flow velocities as well as the flow losses are reduced thereby. Optionally a shortening of the range can even be provided to increase the pressure ratio without reducing the total outflow cross section of the area and the pressure slot (pressure outlet). In accordance with the invention, significantly increased suction volume flow (approximately 10% on the average) and a significantly reduced power consumption (approximately 15% on the average) can be achieved with radial slots which traverse the control disc perpendicularly thereto, i.e., at a penetration angle $\alpha$ of 90°. If the penetration angle is reduced, decreaslng toward zero in the limit, the improvement can be enhanced even further, i.e., a reduction of the power consumption beyond 15% and a suction-volume flow increased by more than 10% can be obtained.

In the case of curved blades it is advantageous if the contour of the radial slots is curved correspondingly.

DETAILED DESCRIPTION

Figure 1:
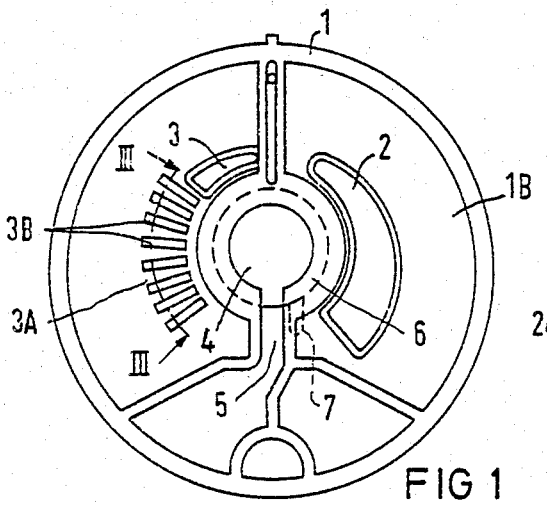
FIG. 1 is a rear elevational view of a control disc, in accordance with the present invention, for a liquid-ring compressor having a machine housing with a circular inner contour, showing a multiplicity of radial pressure slots.
Figure 7:
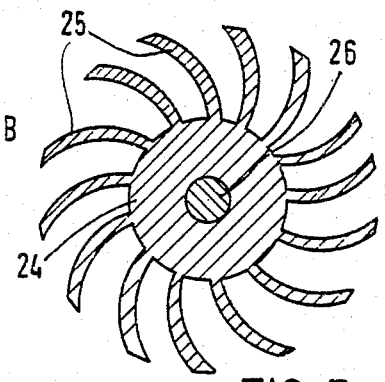
FIG. 7 is a transverse cross-sectional view of an impeller of a liquid-ring compressor having a control disc in accordance with the present invention.
Figure 2:
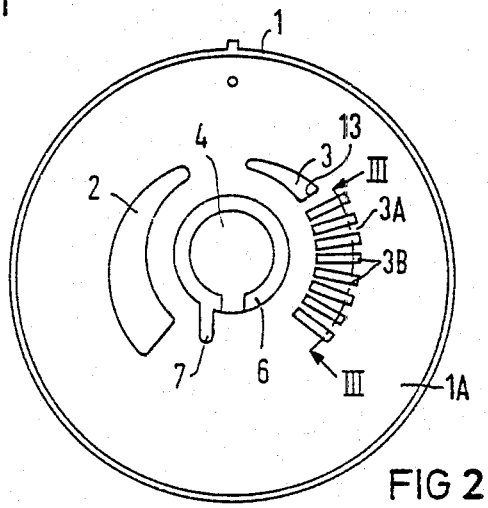
FIG. 2 is a front elevational view of the control disc of FIG. 1.

In a liquid-ring rotary compressor, a control disc 1, as illustrated in FIG. 1, is disposed between one of two support plates in the form of end bells (not illustrated) and a machine housing (not illustrated) having a circular inner contour, i.e., a cylindrical compression chamber. The compression chamber encloses an impeller 24 (see FIG. 7) having a shaft 26 with ends journaled in the bells, while the bell juxtaposed to the control disc is equipped with inlet and outlet stubs for the gas to be transported and compressed and with a pressurized liquid feed line. The flat circular control disc 1 (See FIGS. 1 and 2) has a sickle-shaped suction or intake slot 2 and a sickle-shaped pressure or outlet slot 3 with ancillary radial slots 3B preceding the latter, as determined by direction of rotation of the impeller. An identical control disc can be inserted between the machine housing and the other end bell, if the design of the compressor is symmetrical; if the other end bell serves only to support the impeller shaft, an annular plate may be used instead of another control disc. Control disc 1, as well as each end bell, has an eccentrically disposed shaft gland surrounded by a ring-shaped pressurized-liquid passage 6 with an inflow groove 7 behind the suction slots; passage 6 is in communication with a pressurized-liquid inlet 5. Radial slots 3B are located in an arc-shaped region 3A ahead of pressure slot 3 and are of approximately equal length and spaced from each other, the width of slots 3B being adapted to the blade thickness of the impeller. The length of radial slots 3B is more than twice the slot width and is longer than the radially-extending leading edge 13 of suction slot 3. The entire angular or circumferential extent of the pressure outlet comprising pressure slot 3 and radial openings or slots 3B corresponds approximately to the angular or circumferential extent of suction slot 2.

Figure 3:
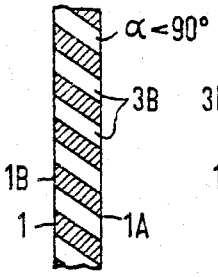
FIG. 3 is a partial cross-sectional view taken along line III—III, in FIGS. 1 and 2.
Figure 4:
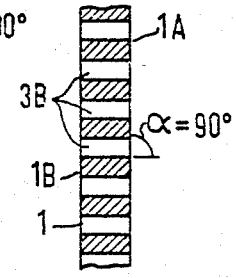
FIG. 4 is a partial cross-sectional view similar to FIG. 3.

As shown in FIGS. 1–4, control disc 1 has a front side or surface 1A which faces the impeller and a back side or surface 1B parallel to the front surface. Radial slots 3B which are directed transversely to the control disc 1, i.e. at a 90° penetration angle $\alpha$ relative to the faces or surfaces 1A and 1B, as illustrated in FIG. 4, can be made and calibrated simply. For a gas flow with the lowest possible flow resistance from the blade chambers of the impeller toward the pressure outlet, it is advantageous to provide radial slots 3B inclined at an acute angle between control disc surfaces or faces 1A and 1B, as shown in FIG. 3. A maximum outflow cross section is thereby made effectively available.

Figure 5:
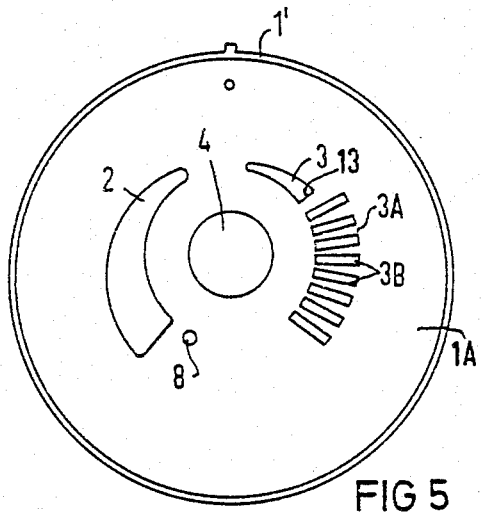
FIG. 5 is a front elevational view of another control disc, in accordance with the present invention, for a liquid-ring compressor.

FIG. 5 shows a control disc 1' with a circulating-liquid aperture 8 disposed behind the suction slot 2, relative to the direction of impeller rotation, as well as radial slots 3B disposed in arc shaped region 3A ahead of pressure slot 3.

Figure 6:
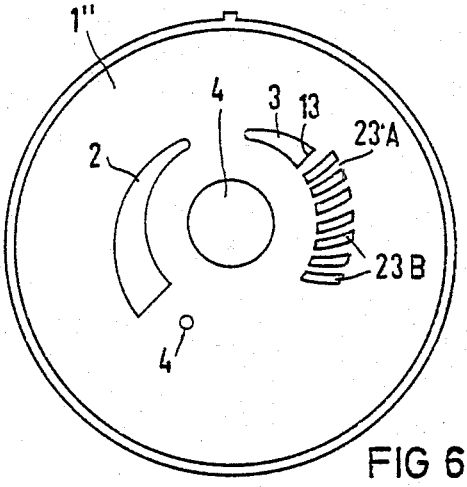
FIG. 6 is a front elevational view of yet another control disc, in accordance with the present invention, for a liquid-ring compressor.

As illustrated in FIG. 6, a control disc 1'' according to the present invention is advantageously provided, in the case of an impeller 24 with blades 25 (see FIG. 7) having an arcuate transverse cross section, with substantially radially extending arcuate slots 23B having a curvature identical to that of the impeller blades 25. Slots 23B are circumferentially spaced from each other in an arc-shaped region 23A preceding pressure slot 3, relative to the direction of impeller rotation, region 23A extending radially beyond the leading edge 13 of slot 3.

Preferably, arc-shaped regions 3A and 23A have uniform radial widths. Concomitantly, slots 3B and 23B have uniform lengths.

What is claimed is:

1. In a control disc of a liquid-ring compressor having an impeller with a multiplicity of radially extending blades, said control disc being provided with a sickle-shaped suction slot and a sickle-shaped pressure slot having a substantially radial leading edge, said control disc being further provided with a multiplicity of ancillary pressure openings disposed in an arc-shaped region extending circumferentially in front of said pressure slot, as determined by the direction of rotation of said impeller, said arc-shaped region extending in a radial direction beyond the outer end of said leading edge, the improvement wherein said pressure openings are substantially radially extending slots spaced from each other in the circumferential direction, the ratio of the widths of the slots to the thickness of the blades of the impeller being less than 1.2 to 1, said control disc having a planar surface on a side facing said impeller, said blades having an arcuate cross-section in a plane parallel to said surface and said radially extending slots having, in the plane of said surface, an arcuate shape substantially identical in curvature to said cross-section.

2. The improvement defined in claim 1 wherein said arc-shaped region has a uniform radial width.

3. The improvement defined in claim 2 wherein each of said radially extending slots as a length greater than twice the respective slot width.

4. The improvement defined in claim 3 wherein said control disc has two parallel circular faces and said radially extending slots pass through said control disc perpendicularly to said faces, said planar surface constituting one of said faces.

5. The improvement defined in claim 3 wherein said control disc has a pair of parallel circular faces and said radially extending slots pass through said control disc at an acute angle with respect to said faces, said planar surface constituting one of said faces.

6. The improvement defined in claim 1 wherein each of said radially extending slots has a length greater than twice the respective slot width.

7. The improvement defined in claim 6 wherein said control disc has two parallel circular faces and said radially extending slots pass through said control disc perpendicularly to said faces, said planar surface constituting one of said faces.

8. The improvement defined in claim 6 wherein said control disc has a pair of parallel circular faces and said radially extending slots pass through said control disc at an acute angle with respect to said faces, said planar surface constituting one of said faces.

9. The improvement defined in claim 1 wherein said control disc has two parallel circular faces and said radially extending slots pass through said control disc perpendicularly to said faces, said planar surface constituting one of said faces.

10. The improvement defined in claim 1 wherein said control disc has a pair of parallel circular faces and said radially extending slots pass through said control disc at an acute angle with respect to said faces, said planar surface constituting one of said faces.

11. In a control disc of a liquid-ring compressor having an impeller with a multiplicity of radially extending blades, said control disc being provided with a sickle-shaped suction slot and a sickle-shaped pressure slot having a substantially radial leading edge, said control disc being further provided with a multiplicity of ancillary pressure openings disposed in an arc-shaped region extending circumferentially in front of said pressure slot, as determined by the direction of rotation of said impeller, said arc-shaped region extending in a radial direction beyond the outer end of said leading edge, the improvement wherein said pressure openings are substantially radially extending slots spaced from each other in the circumferential direction, the ratio of the widths of the slots to the thickness of the blades of the impeller being less than 1.2 to 1, the arc-shaped region having a uniform radial width.

* * * * *